US007182881B2

(12) United States Patent
Kato et al.

(10) Patent No.: US 7,182,881 B2
(45) Date of Patent: Feb. 27, 2007

(54) FIRE EXTINGUISHING AGENT AND FIRE EXTINGUISHER

(75) Inventors: Masahiro Kato, Naka-gun (JP); Sawako Yoshikawa, Yokohama (JP); Kenji Essaki, Kawasaki (JP); Kazuaki Nakagawa, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 225 days.

(21) Appl. No.: 10/640,378

(22) Filed: Aug. 14, 2003

(65) Prior Publication Data

US 2004/0118576 A1 Jun. 24, 2004

(30) Foreign Application Priority Data

Aug. 14, 2002 (JP) ..... 2002-236224
Jan. 31, 2003 (JP) ..... 2003-023628

(51) Int. Cl.

*A62D 1/02* (2006.01)
*A62D 1/06* (2006.01)
*A62D 1/08* (2006.01)
*A62C 3/00* (2006.01)

(52) U.S. Cl. ..... 252/7; 252/5; 252/6; 252/6.5; 252/8; 169/46; 169/47; 169/71; 169/85

(58) Field of Classification Search ..... 252/7
See application file for complete search history.

(56) References Cited

U.S. PATENT DOCUMENTS 2,631,977 A * 3/1953 Allen et al. ..... 252/7
3,553,127 A * 1/1971 Warnock et al. ..... 252/5
3,889,754 A * 6/1975 Dunn ..... 169/59
3,889,757 A * 6/1975 Dunn ..... 169/59
3,889,758 A * 6/1975 Dunn ..... 169/74
3,918,526 A * 11/1975 Hattori et al. ..... 169/51
4,042,521 A * 8/1977 Dunn ..... 252/5
4,346,012 A * 8/1982 Umaba et al. ..... 252/7
4,909,328 A * 3/1990 DeChant et al. ..... 169/30
4,915,853 A * 4/1990 Yamaguchi ..... 252/2
5,053,147 A * 10/1991 Kaylor ..... 252/7
5,868,205 A * 2/1999 Cunningham et al. ..... 169/65
6,019,177 A * 2/2000 Olander ..... 169/46
6,217,788 B1 * 4/2001 Wucherer et al. ..... 252/5
6,277,296 B1 8/2001 Scheffee et al.
6,660,190 B2 * 12/2003 Huhn ..... 252/602
2004/0118576 A1 * 6/2004 Kato et al. ..... 169/71

FOREIGN PATENT DOCUMENTS

JP 11-206910 8/1999
JP 2002-165897 6/2002
JP 2002-291940 10/2002

* cited by examiner

*Primary Examiner*—Joseph D. Anthony
(74) *Attorney, Agent, or Firm*—Oblon, Spivak, McClelland, Maier & Neustadt, P.C.

(57) ABSTRACT

A fire extinguishing agent contains at least one compound selected from the group consisting of an alkali hydrogencarbonate and an alkali carbonate, the alkali hydrogencarbonate being thermally decomposed to generate carbon dioxide and an alkali carbonate, a metal oxide that reacts with the alkali carbonate to generate carbon dioxide, and a hydrophobic binder.

11 Claims, 2 Drawing Sheets

FIRE EXTINGUISHING AGENT AND FIRE EXTINGUISHER

CROSS-REFERENCE TO RELATED APPLICATIONS

This application is based upon and claims the benefit of priority from the prior Japanese Patent Applications No. 2002-236224, filed Aug. 14, 2002; and No. 2003-023628, filed Jan. 31, 2003, the entire contents of both of which are incorporated herein by reference.

BACKGROUND OF THE INVENTION

1. Field of the Invention

The present invention relates to a fire extinguishing agent and a fire extinguisher, particularly, to a fire extinguishing agent that releases carbon dioxide and a fire extinguisher using this fire extinguishing agent.

2. Description of the Related Art

It was customary to use a fire extinguisher having a fire extinguishing agent housed therein for extinguishing a small fire. The known fire extinguishing agents include, for example, alkali hydrogencarbonates such as sodium hydrogencarbonate and potassium hydrogencarbonate. If put in the fire, these fire extinguishing agents generate carbon dioxide by the reaction denoted by formula (1) given below so as to lower the oxygen concentration and, thus, to exhibit a fire extinguishing function:

$$2NaHCO_3 \rightarrow CO_2 + H_2O + Na_2CO_3 \quad (1)$$

Also, the alkali ions exhibit high reactivity with OH radicals. Therefore, if the alkali hydrogencarbonate in the form of a fine powder is released into a flame together with the air stream, the alkali ions serve to suppress the chain reaction with the OH radicals within the flame so as to contribute to the fire extinguishing function.

On the other hand, improvement in the fire extinguishing efficiency per unit volume of the fire extinguishing agent is required in compliance with the demands for improvement in operability of the fire extinguisher or for reduction in space needed for installation. Also, it is stipulated in a ministerial ordinance specifying the technical standards of the fire extinguishing agents for the fire extinguisher, i.e., Ordinance No. 28 of the Ministry of Home Affairs dated Sep. 17, 1964, that the fire extinguishing agent should not be settled on the bottom within one hour when the fire extinguishing agent is uniformly sprayed on the water surface in order to permit the fire extinguishing agent to be capable of coping with both wood fires and oil fires.

Japanese Patent Disclosure (Kokai) No. 11-206910 discloses a fire extinguishing agent prepared by granulating, for example, an alkali hydrogencarbonate by using a hydrophilic binder such as carboxymethylcellulose or starch so as to increase the grain density of the fire extinguishing agent and, thus, to facilitate arrival of the fire extinguishing agent at a burning material. This document also teaches an idea of adding an auxiliary (water repellent) such as white carbon, organic silicone oil or metallic soap to the fire extinguishing agent so as to permit the fire extinguishing agent to exhibit water repellency.

However, in the fire extinguishing agent disclosed in the document quoted above, it is essential to apply heat treatment to the water repellent at about 150° C. What should be noted is that it is possible for the reaction denoted by formula (1) given above to take place during the heat treatment, which deteriorates the fire extinguishing agent.

BRIEF SUMMARY OF THE INVENTION

An object of the present invention is to provide a fire extinguishing agent exhibiting high water repellency and high fire extinguishing efficiency and a fire extinguisher using the particular fire extinguishing agent.

A fire extinguishing agent according to an aspect of the present invention comprises at least one compound selected from the group consisting of an alkali hydrogencarbonate and an alkali carbonate, the alkali hydrogencarbonate being thermally decomposed to generate carbon dioxide and an alkali carbonate, a metal oxide that reacts with the alkali carbonate to generate carbon dioxide, and a hydrophobic binder.

A fire extinguisher according to another aspect of the present invention comprises the fire extinguishing agent defined above, a housing vessel housing the fire extinguishing agent, and a compressed carrier gas enabling the fire extinguishing agent to be spurted from within the housing vessel.

DETAILED DESCRIPTION OF THE INVENTION

Figure 1:
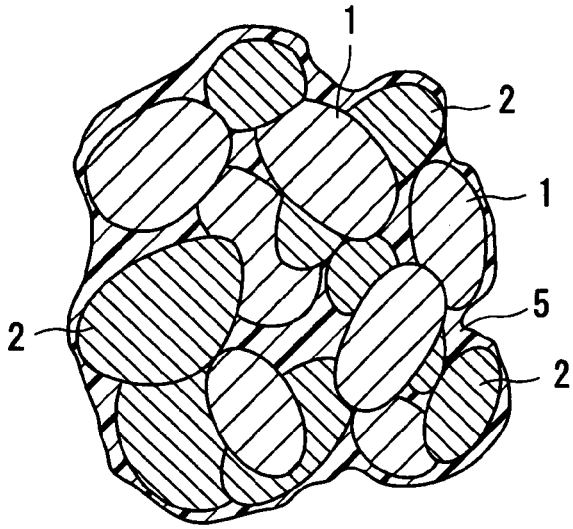
FIG. 1 is a cross sectional view schematically showing the fire extinguishing agent according to an embodiment of the present invention.

The embodiments of the present invention will now be described.

The fire extinguishing agent according to the embodiments of the present invention comprises at least one compound selected from the group consisting of an alkali hydrogencarbonate and an alkali carbonate, a metal oxide, and a hydrophobic binder. Each of the components of the fire extinguishing agent according to the embodiment of the present invention will now be described.

The alkali hydrogencarbonate used in the present invention is thermally decomposed, if heated, so as to generate carbon dioxide and an alkali carbonate. The alkali hydrogencarbonate used in the present invention includes sodium hydrogencarbonate, potassium hydrogencarbonate and lithium hydrogencarbonate.

The carbon dioxide generated by the thermal decomposition of the alkali hydrogencarbonate lowers the oxygen concentration and, thus, the carbon dioxide contributes to the fire extinguishing function. In addition, the alkali carbonate formed by the thermal decomposition of the alkali hydrogencarbonate reacts with the metal oxide referred to herein later so as to form carbon dioxide and an alkali metal-containing complex oxide. The carbon dioxide generated by this reaction also lowers the oxygen concentration so as to contribute to the fire extinguishing function.

As described above, carbon dioxide is also generated by the reaction between an alkali carbonate and a metal oxide. Therefore, it is possible to use an alkali carbonate alone without using an alkali hydrogencarbonate as a raw material of the fire extinguishing agent according to the embodiments of the present invention. The alkali carbonate used in the present invention includes sodium carbonate, potassium carbonate and lithium carbonate.

The metal oxide used in the present invention is not particularly limited as long as the metal oxide is capable of reacting with an alkali carbonate so as to generate carbon dioxide and an alkali metal-containing complex oxide. To be more specific, the metal oxide used in the present invention includes zirconium oxide, silicon oxide, sodium silicate, iron oxide and nickel oxide. The metal oxide increases the carbon dioxide generation through the reaction with the alkali carbonate and, thus, the metal oxide permits enhancing the fire extinguishing function of the fire extinguishing agent according to the embodiments of the present invention.

The hydrophobic binder is used in the present invention for granulating a mixture containing at least one kind of a compound selected from the group consisting of an alkali hydrogencarbonate and an alkali carbonate and a metal oxide so as to obtain a granular fire extinguishing agent. The hydrophobic binder, which produces water-repelling effect so as to cause the fire extinguishing agent to float on the water surface, permits enhancing the fire extinguishing effect of the fire extinguishing agent according to the embodiments of the present invention. The hydrophobic binder used in the present invention includes polyvinyl butyral, liquid paraffin, wax emulsion, polyvinyl acetate, and a fluorine-containing polymer having a polyfluoroalkyl group. The fluorine-containing polymer included in the hydrophobic binders given above exhibits oil repellency in addition to the water repellency. Therefore, in the case of using the fluorine-containing polymer as the hydrophobic binder, it is possible to permit the fire extinguishing agent to float on the oil surface so as to make it possible to cope with oil fires.

Figure 2:
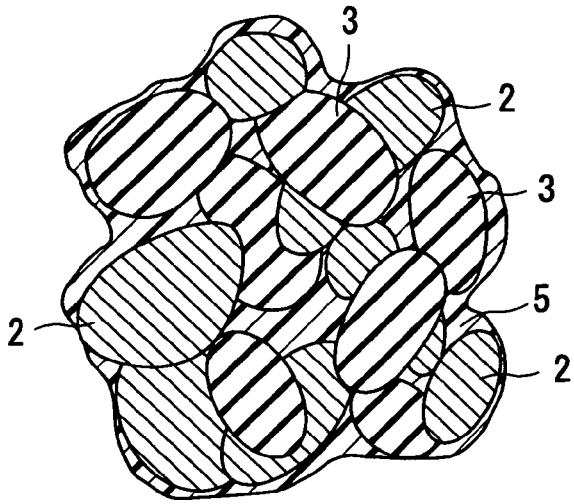
FIG. 2 is a cross sectional view schematically showing the intermediate of the fire extinguishing agent according to an embodiment of the present invention.
Figure 3:
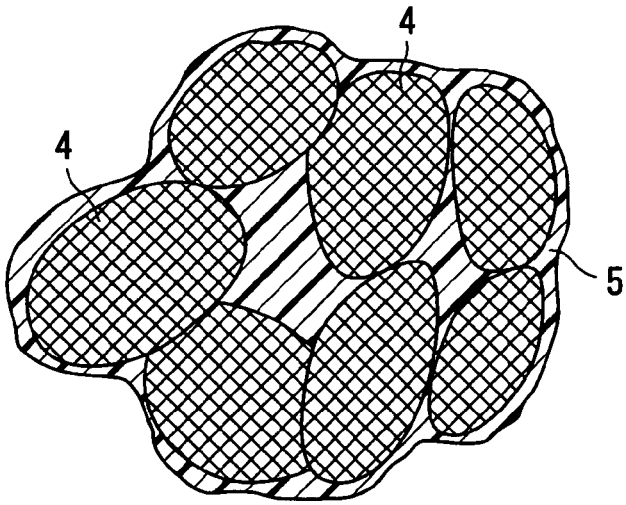
FIG. 3 is a cross sectional view showing the state after use of the fire extinguishing agent according to an embodiment of the present invention.

The fire extinguishing function produced by the fire extinguishing agent according to the embodiments of the present invention will now be described with reference to FIGS. 1 to 3. FIG. 1 is a cross sectional view schematically showing the state before use of the fire extinguishing agent according to an embodiment of the present invention. FIG. 2 is a cross sectional view showing the intermediate of the fire extinguishing agent. Further, FIG. 3 is a cross sectional view showing the state after use of the fire extinguishing agent. The following description covers a typical fire extinguishing agent in which sodium hydrogencarbonate ($NaHCO_3$) is used as an alkali hydrogencarbonate and zirconium oxide ($ZrO_2$) is used as a metal oxide.

As shown in FIG. 1, the fire extinguishing agent before use is in the form of a grain in which the sodium hydrogencarbonate particles 1 and the zirconium oxide particles 2 are strongly bonded to each other by the hydrophobic binder 5. Water repellency is imparted to the fire extinguishing agent by the hydrophobic binder 5. Since water does not permeate into the inner region of the grain, it is possible for the fire extinguishing agent to float on the water surface. The fire extinguishing agent grain is depicted in FIG. 1 as if the grain is covered completely with the hydrophobic binder 5. However, it is not necessary for the grain to be covered completely with the hydrophobic binder 5. It suffices for the grain to be covered with the hydrophobic binder 5 to such an extent as to permit the grain to float on the water surface.

If the fire extinguishing agent, prepared by granulating a mixture consisting of the sodium hydrogencarbonate particles 1 and the zirconium oxide particles 2 by using the hydrophobic binder 5, is put in the fire, the sodium hydrogencarbonate particles 1 are thermally decomposed first as shown in formula (1) given below:

$$2NaHCO_2 \rightarrow CO_2\uparrow + H_2O\uparrow + Na_2CO_3 \quad (1)$$

The reaction denoted by formula (1) is called a first stage reaction. By this reaction, carbon dioxide, water and sodium carbonate are generated as decomposition products. Since the carbon dioxide generated by this reaction lowers the oxygen concentration in the atmosphere, the fire extinguishing function is produced.

After the first stage reaction, the fire extinguishing agent is changed into an intermediate containing sodium carbonate particles 3 and zirconium oxide particles 2, as shown in FIG. 2. Although the hydrophobic binder 5 begins to be melted, the intermediate grain continues to be capable of floating on the water surface. Also in this stage, even if the surface of the intermediate grain is not covered completely with the hydrophobic binder 5, the intermediate is capable of floating on the water surface.

It should also be noted that sodium contained in the sodium carbonate particles 3 is diffused into the inner region of the zirconium oxide particles 2 constituting the intermediate, with the result that a reaction is carried out between sodium carbonate and zirconium oxide as denoted by formula (2) given below:

$$Na_2CO_3 + ZrO_2 \rightarrow Na_2ZrO_3 + CO_2\uparrow \quad (2)$$

The reaction denoted by formula (2) is called a second stage reaction. Sodium zirconate, which is an alkali metal-containing complex oxide, and carbon dioxide are generated by this second stage reaction. The carbon dioxide generated by this reaction serves to lower the oxygen concentration in the atmosphere and, thus, contributes to the fire extinguishing function.

After the second stage reaction, the fire extinguishing agent is changed into a grain containing mainly the sodium zirconate particles 4 as shown in FIG. 3. In this stage, the hydrophobic binder 5 is melted by heat and partly evaporated. However, since the temperature of the grain is lowered due to the fire extinguishing function, a major portion of the hydrophobic binder 5 is present in the gaps between the sodium zirconate particles 4 and on the surface of the fire extinguishing agent grains, with the result that the grains remain on the water surface.

As described above, in the fire extinguishing agent according to the embodiments of the present invention, the reactions denoted by formulas (1) and (2) are brought about in the case of using an alkali hydrogencarbonate and a metal oxide, and the reaction denoted by formula (2) is brought about in the case of using an alkali carbonate and a metal oxide. In the fire extinguishing agent according to the embodiment of the present invention, carbon dioxide is generated by these reactions in an amount larger than that generated in the case of using the conventional fire extinguishing agent. As a result, a fire extinguishing function equal to that in the conventional fire extinguishing agent can be produced even if the amount of the fire extinguishing agent used is decreased, compared with the conventional fire extinguishing agent. It should also be noted that the fire extinguishing agent according to the embodiments of the present invention contains a water repelling hydrophobic binder and permits obtaining a high carbon dioxide generation per unit volume even under the state of floating on the water surface. It follows that the fire extinguishing agent according to the embodiments of the present invention is capable of coping with various kinds of fires with high fire extinguishing efficiency.

The fire extinguishing function described above with reference to FIGS. 1 to 3 can be also obtained in the case where a fluorine-containing polymer, e.g., a polymer of $C_8F_{17}(CH_2)_2OCOCH{=}CH_2$, is used as the hydrophobic binder 5. In addition, the fluorine-containing polymer having a polyfluoroalkyl group has surface tension higher than that of water or oil and, thus, exhibits not only high water repellency but also high oil repellency. It follows that water and oil are prevented from entering the inner region of the fire extinguishing agent, and the fire extinguishing agent thus floats on the water or oil surface. As a result, the fire extinguishing agent, in which a fluorine-containing polymer having a polyfluoroalkyl group is used as the hydrophobic agent 5, is also capable of coping with oil fires.

The fire extinguishing agent according to the embodiments of the present invention will now be described in more detail.

As described above, the alkali hydrogencarbonate used in the present invention includes sodium hydrogencarbonate, potassium hydrogencarbonate and lithium hydrogencarbonate. Potassium hydrogencarbonate or lithium hydrogencarbonate is also capable of generating carbon dioxide efficiently in the first stage reaction and the second stage reaction, like sodium hydrogencarbonate described above. Among these alkali hydrogencarbonates, it is desirable to use sodium hydrogencarbonate and potassium hydrogencarbonate. Particularly, it is desirable to use sodium hydrogencarbonate. Sodium hydrogencarbonate and potassium hydrogencarbonate are superior to lithium hydrogencarbonate in chemical stability at room temperature and, thus, they are practically desirable in terms of storage stability. It should also be noted that sodium carbonate generated from sodium hydrogencarbonate through the first stage reaction has high reactivity with the metal oxide and, thus, it is possible to promote the releasing rate of carbon dioxide. It follows that the fire extinguishing time can be reduced.

As described above, the metal oxide used in the present invention includes zirconium oxide ($ZrO_2$), silicon oxide ($SiO_2$), sodium silicate ($Na_2SiO_3$), iron oxide ($Fe_2O_3$), and nickel oxide (NiO). The fire extinguishing agent containing, for example, sodium hydrogencarbonate and any of the metal oxides referred to above brings about a second stage reaction denoted by any of formulas (2) to (7) given below after the first stage reaction denoted by formula (1) given below. Naturally, carbon dioxide is generated in each of the first stage reaction and the second stage reaction.

First Stage Reaction:

$$2NaHCO_3 \rightarrow CO_2\uparrow + H_2O\uparrow + Na_2CO_3 \quad (1)$$

Second Stage Reaction:

Where zirconium oxide is used as the metal oxide:

$$Na_2CO_3 + ZrO_2 \rightarrow Na_2ZrO_3 + CO_2\uparrow \quad (2)$$

Where silicon dioxide is used as the metal oxide (reaction scheme A):

$$Na_2CO_3 + SiO_2 \rightarrow Na_2SiO_3 + CO_2\uparrow \quad (3)$$

Where silicon dioxide is used as the metal oxide (reaction scheme B):

$$Na_2CO_3 + \tfrac{1}{2}SiO_2 \rightarrow \tfrac{1}{2}Na_4SiO_4 + CO_2\uparrow \quad (4)$$

Where sodium silicate is used as the metal oxide:

$$Na_2CO_3 + Na_2SiO_3 \rightarrow Na_4SiO_4 + CO_2\uparrow \quad (5)$$

Where iron oxide is used as the metal oxide:

$$Na_2CO_3 + Fe_2O_3 \rightarrow 2NaFeO_2 + CO_2\uparrow \quad (6)$$

Where nickel oxide is used as the metal oxide:

$$Na_2CO_3 + NiO \rightarrow Na_2NiO_2 + CO_2\uparrow \quad (7)$$

Incidentally, the reaction denoted by formula (4) given above between $SiO_2$ and $Na_2CO_3$ represents the result of the two-stage reaction of the formula (3) and the formula (5). Where $SiO_2$ is used as the metal oxide, it is possible for the reaction denoted by formula (3) or the reaction denoted by formula (4) to be carried out in accordance with the reaction time, i.e., the time before the complete fire extinction. It is particularly desirable to use $SiO_2$ as the metal oxide because the reaction rate between $SiO_2$ and a alkali carbonate is high.

The reaction between the metal oxide such as $ZrO_2$, $SiO_2$, $Na_2Si_2O_3$, $Fe_2O_3$ or NiO and sodium hydrogencarbonate is started at a relatively low temperature. To be more specific, the reaction noted above is started at about 500° C. for the formula (2), at about 400° C. for the formula (3), at about 400° C. for the formula (4), at about 400° C. for the formula (5), at about 300° C. for the formula (6), and at about 400° C. for the formula (7). It follows that the fire extinguishing agent according to the embodiments of the present invention produces the fire extinguishing function even in the case where the temperature at the origin of the fire is relatively low.

Incidentally, each of the reaction formulas (1) to (7) given above covers the case where sodium hydrogencarbonate is used as the alkali hydrogencarbonate. Needless to say, a similar reaction is brought about in the case where potassium hydrogencarbonate or lithium hydrogencarbonate is used as the alkali hydrogencarbonate.

As described above, the alkali carbonate used in the present invention includes sodium carbonate, potassium carbonate and lithium carbonate. Each of these alkali carbonates carries out a reaction with the metal oxide so as to release carbon dioxide efficiently, as apparent from formulas (2) to (7). Incidentally, each of the formulas (2) to (7) covers the case where sodium carbonate is used as the alkali carbonate. Needless to say, the similar reaction is brought about in the case where potassium carbonate or lithium carbonate is used as the alkali carbonate. It is desirable to use sodium carbonate or lithium carbonate as the alkali carbonate. Particularly, it is desirable to use lithium carbonate. It is desirable to use sodium carbonate or lithium carbonate because these alkali carbonates carry out a reaction with the metal oxide at a high reaction rate. In addition, it is more desirable to use lithium carbonate because it has a low weight per mol.

It is also possible to use two or more alkali hydrogencarbonates. When two or more alkali hydrogencarbonates are used, the alkali carbonates produced in the first stage reaction form a eutectic salt and, thus, are melted promptly. As a result, the rate of the reaction with the metal oxide in the second stage is enhanced. It follows that the releasing rate of carbon dioxide can be further increased. In order to form the eutectic salt, it is possible to use a plurality of alkali hydrogencarbonates, to use at least one alkali hydrogencarbonate and at least one alkali carbonate differing to each other in the alkali metal contained therein, or to use a plurality of alkali carbonates.

As described previously, the hydrophobic binder used in the present invention includes polyvinyl butyral, liquid paraffin, wax emulsion, and polyvinyl acetate. These hydrophobic binders are desirable because they exhibit high water repellency. Among these materials, polyvinyl butyral and liquid paraffin are desirable because they exhibit compatibility with the alkali hydrogencarbonate. In particular, polyvinyl butyral is desirable because it is tough, flexible, excellent in bonding strength and satisfactory in low temperature resistance. It is desirable for the hydrophobic binder not to exhibit polarity as much as possible. In other words, it is desirable to use a hydrophobic binder that does not have a polar atom of O, N and S and has a non-polar carbon atom in the side chain. A hydrophobic binder having a group such as an alkyl group ($—C_nH_{2n+1}$), a phenyl group ($—C_6H_5$) or a perfluoro group ($—C_nF_{2n+1}$) is particularly desirable.

As described above, it is possible to use as the hydrophobic binder a fluorine-containing polymer having a polyfluoroalkyl group, which exhibits oil repellency. The fire extinguishing agent according to the embodiments of the present invention contains metal oxide. The metal oxide reacts with water contained in the atmosphere to form a hydroxyl group. Where, for example, $SiO_2$ is used as the metal oxide, SiOH is generated. Since the hydroxyl group thus generated is easily coupled with the polyfluoroalkyl group, the fluorine-containing polymer having a polyfluoroalkyl group acts as a binder. It follows that a mixture containing an alkali hydrogencarbonate or an alkali carbonate together with a metal oxide can be granulated with the fluorine-containing polymer, without using another binder.

The polyfluoroalkyl group, hereinafter referred to as an "Rf" group, included in the fluorine-containing polymer means an alkyl group having at least two fluorine atoms substituting hydrogen atoms. The Rf group can include an ether oxygen atom in the carbon-carbon bond. The oil repellency of the fluorine-containing polymer is improved with increase in the number of carbon atoms in the Rf group. However, it is difficult to synthesize a fluorine-containing polymer having an Rf group containing 20 or more carbon atoms while controlling characteristics thereof. Also, such a fluorine-containing polymer is unlikely to be dissolved in a solvent. Such being the situation, it is desirable for the Rf group to have 1 to 20 carbon atoms, more desirably 4 to 16 carbon atoms, and still more desirably 6 to 12 carbon atoms. It is possible for the Rf group to be linear or branched, though an Rf group of a linear structure is desired. A fluorine-containing polymer having an Rf group of a branched structure is acceptable in the case where the branched group is positioned at the end of the Rf group and forms a short chain of 1 to 3 carbon atoms, because such a fluorine-containing polymer can be synthesized easily while controlling the characteristics thereof.

It is desirable for the Rf group to have at least 60% of the fluorine atom content represented by "F/H×100 (%)", where F denotes the number of fluorine atoms contained in the Rf group, and H denotes the number of hydrogen atoms contained in the alkyl group corresponding to the Rf group. It is more desirable for the Rf group to have at least 80% of the fluorine atom content, most desirably to have substantially 100% of the fluorine atom content. In other words, it is most desirable to use a perfluoroalkyl group in which all the hydrogen atoms in the alkyl group are replaced by the fluorine atoms. It should be noted that the oil repellency is increased substantially in proportion to the fluorine atom content, and sufficiently high oil repellency can be obtained in the case where the Rf group has at least 60% of the fluorine atom content.

In general, it is desirable for the Rf group to have a perfluoroalkyl group as an end group. However, it is also possible for the Rf group to have a hydrogen atom or a chlorine atom at the end. It is also possible for the Rf group to have an ether oxygen atom included in the carbon-carbon bond. For example, it is possible for the Rf group to be an oxypolyfluoroalkylene group.

Specific examples of the Rf groups are as follows. Here, the Rf groups are represented by general formula and groups corresponding to structural isomers included in the general formula. That is, the Rf groups include $C_4F_9$— (examples of the structural isomers including $CF_3(CF_2)_3$—, $(CF_3)_2CFCF_2$—, $(CF_3)_3C$— and $CF_3CF_2CF(CF_3)$—), $C_5F_{11}$— (examples of the structural isomers including $CF_3(CF_2)_4$—, $(CF_3)_2CF(CF_2)_2$—, $(CF_3)_3CCF_2$— and $CF_3(CF_2)_2CF(CF_3)$—), $C_6F_{13}$— (examples of the structural isomers including $CF_3(CF_2)_2C(CF_3)_2$—), $C_8F_{17}$—, $C_{10}F_{21}$—, $C_{12}F_{25}$—, $C_{14}F_{29}$—, $C_{16}F_{31}$—, $C_{18}F_{37}$—, and $(CF_3)_2CFC_sF_{2s}$ where S denotes an integer falling within a range of between 1 and 15, $HC_tF_{2t}$— where t denotes an integer falling within a range of between 1 and 18, tetrafluorophenyl group, 3-trifluoromethylphenyl group, and 1,3-bis(trifluoromethyl)phenyl group.

Examples of the Rf group having an ether oxygen atom include:

$CF_3(CF_2)_4OCF(CF_3)$—;

$F[CF(CF_3)CF_2O]_uCF(CF_3)$—, where u denotes an integer falling within a range of between 1 and 10;

$F(CF_2CF_2CF_2O)_vCF_2CF_2$—, where v denotes an integer falling within a range of between 1 and 11;

$F(CF_2CF_2O)_wCF_2CF_2$—, where w denotes an integer falling within a range of between 1 and 11; and $F[CF(CF_3)CF_2O]_mCF(CF_3)$— where m denotes an integer falling within a range of between 1 and 10, preferably between 1 and 6.

The fluorine-containing polymer used in the present invention is not particularly limited as long as the polymer has the Rf group described above. It is desirable to use a fluorine-containing polymer including an acrylic monomer unit having the Rf group or a methacrylic monomer unit having the Rf group. These fluorine-containing polymers are inexpensive and are soluble to various kinds of solvents and can be synthesized easily. Incidentally, the acrylate and methacrylate are collectively referred to as (meth)acrylate in the following description.

It is desirable to use a (meth)acrylic monomer unit having the Rf group represented by a general formula $CH_2{=}C(R^1)COOQRf$ (where $R^1$ denotes a hydrogen atom or a methyl group, and Q denotes a divalent organic group), because characteristics thereof can be controlled easily. Suitable divalent organic group Q may be a linear or branched alkylene group having 1 to 4 carbon atoms, $—R^2NR^3SO_2—$ (where $R^2$ denotes an alkylene group having 1 to 4 carbon atoms and $R^3$ denotes a hydrogen atom or an alkyl group having 1 to 4 carbon atoms), or $—R^4NR^5CO—$ (where $R^4$ denotes an alkylene group having 1 to 4 carbon atoms and $R^5$ denotes a hydrogen atom or an alkyl group having 1 to 4 carbon atoms).

The preferred (meth)acrylic monomers having the Rf group include:

$CH_2{=}C(R^1)COOCH_2Rf$;

$CH_2{=}C(R^1)COOCH_2CH_2Rf$ (which is perfluoroalkylethyl acrylate (PFAA) in the case where $R^1$ is H or perfluoroalkylethyl methacrylate (PFAM) in the case where $R^1$ is $CH_3$);

$CH_2{=}C(R^1)COOCH(CH_3)CH_2Rf$;

$CH_2{=}C(R^1)COOCH_2CH_2NHSO_2Rf$;

$CH_2{=}C(R^1)COOCH_2CH_2NHCORf$;

$CH_2{=}C(R^1)COOCH_2CH_2N(CH_3)SO_2Rf$;

$CH_2{=}C(R^1)COOCH_2CH_2N(CH_3)CORf$;

$CH_2{=}C(R^1)COOCH_2CH_2N(C_2H_5)SO_2Rf$;

$CH_2{=}C(R^1)COOCH_2CH_2N(C_2H_5)CORf$;

$CH_2{=}C(R^1)COOCH_2CH_2N(C_3H_7)SO_2Rf$;

$CH_2{=}C(R^1)COOCH_2N(C_3H_7)CORf$; and $CH_2{=}C(R^1)COOCH(CH_2Cl)CH_2OCH_2CH_2N(CH_3)SO_2Rf$.

It is possible for the fluorine-containing polymer to have one or more (meth)acrylic monomer units each having the Rf group. Where a plurality of monomer units are included in the fluorine-containing polymer, it is desirable to use (meth)acrylates having the Rf groups differing from each other in the number of carbon atoms.

It is particularly desirable to use perfluoroalkylethyl acrylate (PFAA) and perfluoroalkylethyl methacrylate (PFAM) as the fluorine-containing polymers because the perfluoroalkyl group (Rf) included in each of PFAA and PFAM is linear and, thus, PFAA and PFAM can be synthesized easily.

In the fire extinguishing agent according to the embodiments of the present invention, it is desirable for the metal oxide to be contained in an amount falling within a range of between about 20 mol % and about 80 mol % based on the sum of the alkali hydrogencarbonate and/or the alkali carbonate and the metal oxide. If the amount of the metal oxide falls within the range noted above, unreacted metal oxide or unreacted alkali carbonate would not be present after the second stage reaction and efficiency of carbon dioxide generation rate based on the amount of the fire extinguishing agent is high.

In the fire extinguishing agent according to the embodiments of the present invention, it is desirable for the hydrophobic binder to be contained in an amount falling within a range of between about 1 wt % and about 10 wt %. If the amount of the hydrophobic binder is about 1 wt % or more, the fire extinguishing agent grain can be sufficiently coated with the hydrophobic binder so as to produce a water repelling effect. Also, if the amount of the hydrophobic binder is about 10 wt % or less, the thickness of the coating of the hydrophobic binder is not excessively large and, thus, carbon dioxide can be released easily to the outside.

The situation described above also applies to the case where a fluorine-containing polymer having a polyfluoroalkyl group is used as the hydrophobic binder. To be more specific, it is desirable for the fluorine-containing polymer to be contained in the fire extinguishing agent in an amount falling within a range of between about 1 wt % and about 10 wt %. If the amount of the fluorine-containing polymer is about 1 wt % or more, the fire extinguishing agent grain can be coated sufficiently with the fluorine-containing polymer so as to obtain water repelling effect and an oil repelling effect. Also, if the amount of the fluorine-containing polymer is about 10 wt % or less, the thickness of the coating of the fluorine-containing polymer is not excessively large so as to permit carbon dioxide to be released easily to the outside.

In the embodiments of the present invention, the fire extinguishing agent is in the form of grains. If each of the alkali hydrogencarbonate particles or the alkali carbonate particles and the metal oxide particles has a small particle size, it is possible to obtain the fire extinguishing agent grains in which these particles are distributed uniformly. The particular construction of the fire extinguishing agent grain is advantageous in that the reaction between these materials can be promoted. To be more specific, it is desirable for each of these particles to have an average primary particle size of about 1 μm or less.

It is desirable for the fire extinguishing agent in the form of grains according to the embodiments of the present invention to have an average grain size falling within a range of between about 0.5 μm and 5 mm. If the average grain size is 0.5 μm or larger, the spraying distance of the fire extinguishing agent can be increased easily so as to widen the range of use. Also, if the average grain size is about 5 mm or smaller, heat transfer into the inner region of the fire extinguishing agent can be facilitated so as to promote the reaction, with the result that the releasing rate of carbon dioxide can be increased.

It should also be noted that, if the fire extinguishing agent has an average grain size of about 30 μm or smaller, the fire extinguishing agent can be scattered easily into the atmosphere so as to make it possible to enhance the effect of suppressing the chain reaction of the OH radicals within the flame. On the other hand, if the fire extinguishing agent has an average grain size of about 50 μm or larger, it is possible for the origin of the fire to be covered with the fire extinguishing agent before or after the reaction so as to enhance the effect of shielding the origin of the fire from oxygen. Such being the situation, it is desirable to select the grain size of the fire extinguishing agent in accordance with the kind of fire.

In the embodiments of the present invention, it is desirable for the fire extinguishing agent to have a density not higher than 1 $g/cm^3$, more desirably to have a density falling within a range of between 0.8 $g/cm^3$ and 0.95 $g/cm^3$. If the density of the fire extinguishing agent is 0.8 $g/cm^3$ or more, it is possible to decrease the volume of the fire extinguishing agent required for the fire extinction. On the other hand, if the density of the fire extinguishing agent is 0.95 $g/cm^3$ or less, the fire extinguishing agent grains are not settled in water or oil, and all the grains float on the water surface or the oil surface, even if a large amount of fire extinguishing agent is used for the fire extinction.

A solution of the hydrophobic binder is used for preparing, by granulation, the fire extinguishing agent according to the embodiments of the present invention. It is desirable to use acetone or methylene chloride as a solvent of the hydrophobic binder such as polyvinyl butyral, liquid paraffin, wax emulsion or polyvinyl acetate because these hydrophobic binders have a very high solubility in these solvents. The solvents used for dissolving the fluorine-containing polymer having a polyfluoroalkyl group include toluene, ethyl acetate, isopropanol, methylene chloride, dichloropentafluoroethane, m-xylene hexafluoride, and p-xylene hexafluoride.

The granular fire extinguishing agent can be manufactured by a mixing granulating method, a forced granulating method or a thermal granulating method.

The mixing granulating method includes a rolling motion method, a fluidized bed method, a centrifugal fluidized bed method and a stirring method.

In the rolling motion (tumbling) method, a solution prepared by dissolving a powdery material and a hydrophobic binder in a solvent is supplied into an inclined rotary pan, and the granulation is performed with rolling motion by the pan. The grains manufactured by this method are rendered spherical and hard, and there is a wide distribution in grain size. This method is adapted for the manufacture grains having a grain size of, for example, about 100 μm to 5 mm.

In the fluidized bed method, a powdery material is fluidized with blowing hot air, and a binder solution is sprayed onto the fluidized powdery material so as to perform granulation. The grains manufactured by this method are shaped irregular, and the grain size has a wide distribution. The grains manufactured by this method have high porosity.

In the centrifugal fluidized bed method, the granulation is performed by the centrifugal rolling motion of a rotary plate and the spraying of a binder solution. The grains manufactured by this method are rendered completely spherical and hard, and have a narrow grain size distribution. Therefore, this method is adapted for the manufacture of the fire extinguishing agent according to the embodiments of the present invention.

In the stirring method, a powdery material and a binder solution are mixed and stirred at a high speed with rotary vanes so as to manufacture fine grains. The grains manufactured by this method are shaped irregular, and the grain size has a wide distribution.

The grains manufactured by the fluidized bed method or the stirring method tends to have a wide grain size distribution as described above. Therefore, it is desirable to classify the grains and take out the grains having grain sizes falling within a prescribed range.

The forced granulating method includes a compression molding method and an extruding method.

In the compression molding method, a powdery material is mixed with a binder solution, and the resultant mixture is formed by compression rolls into a plate, followed by pulverizing the plate in the subsequent step. The grains manufactured by this method are shaped like flakes, and the grain size has a wide distribution. This method is adapted for the manufacture of the grains having a large grain size, falling within a range of between about 1 mm and 5 mm.

In the extruding method, a mixture of a powdery material and a binder solution is kneaded, and the kneaded product is transferred with a screw so as to be extruded from a cylindrical die, thereby performing granulation. The grains manufactured by this method are shaped cylindrical and have a narrow grain size distribution.

Further, the thermal granulating method includes a melting method and a spray drying method.

In the melting method, a mixture of a powdery material and a molten binder is made into fine drops by using a nozzle, and the fine drops are supplied into a cold air stream for solidifying, thereby performing granulation. The grains manufactured by this method are shaped spherical of bead-like, have a narrow grain size distribution, and have a high hardness.

In the spray drying method, slurry of a powdery material and a binder solution is made into fine drops, and a swirling hot air stream is supplied onto the drops so as to dry and solidify the drops, thereby performing granulation. The grains thus manufactured are shaped spherical and have a wide grain size distribution. This method is adapted for the manufacture of the fire grains having a relatively small grain size falling within a range of, for example, between 5 μm and 500 μm.

Among the various methods described above, it is particularly desirable to employ the rolling motion (tumbling) method because the manufactured fire extinguishing agent is hard, and it can be manufactured easily at a low cost.

The fire extinguishing agent having a desired average grain size and a desired density can be manufactured by appropriately selecting, for example, the manufacturing method, and the average particle sizes of the raw material particles of the alkali hydrogencarbonate or the alkali carbonate and the metal oxide.

The fire extinguishing agent according to the embodiments of the present invention may simply be stored in a container such as a bucket and scattered to the origin of the fire. The fire extinguishing agent according to the embodiments of the present invention may be loaded in a fire extinguisher by which a carrier gas is spurted for transferring the fire extinguishing agent toward the origin of the fire.

Figure 4:
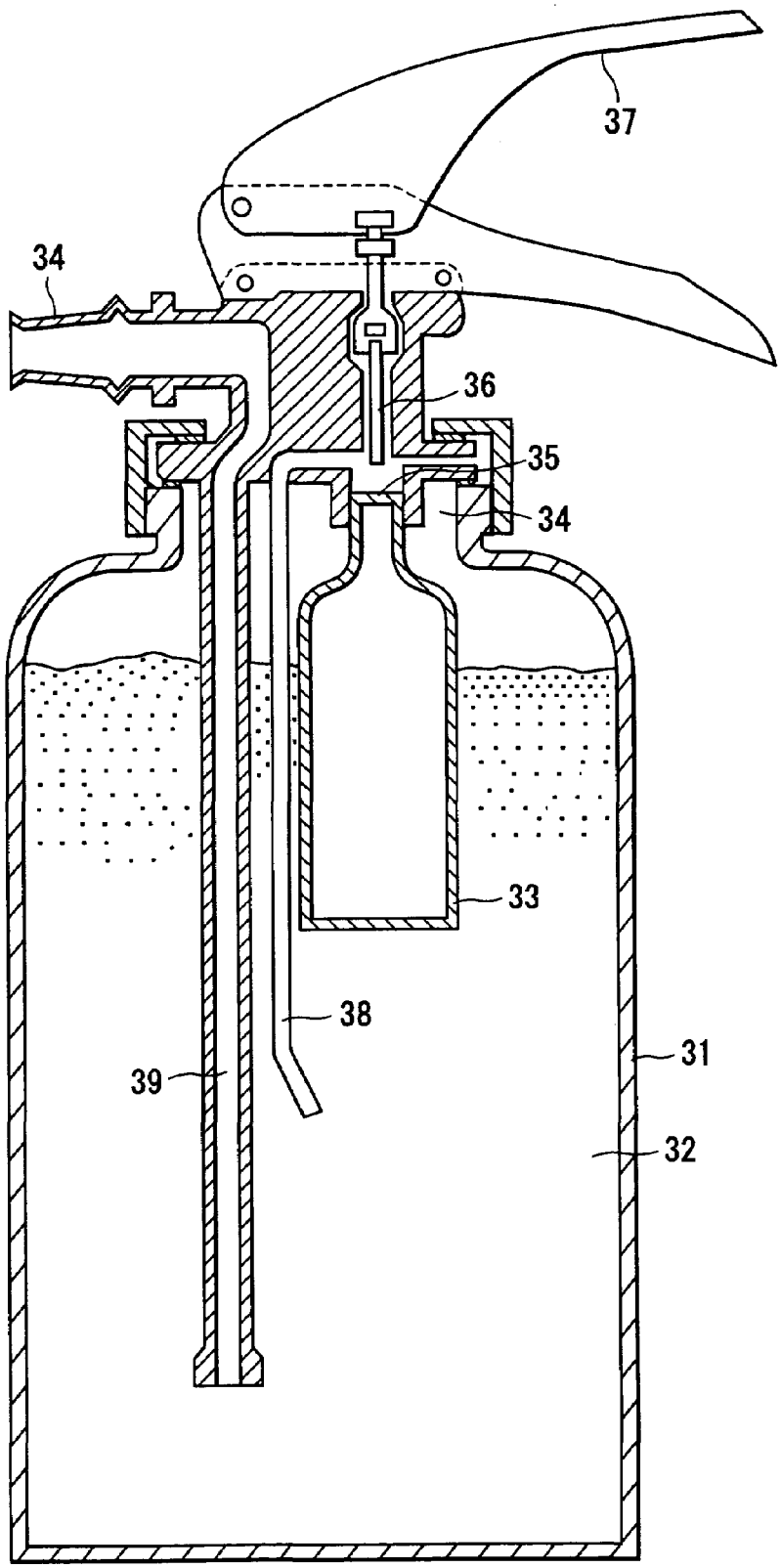
FIG. 4 is a cross sectional view schematically showing the construction of the fire extinguisher according to another embodiment of the present invention.

FIG. 4 is a cross sectional view schematically showing the construction of a fire extinguisher of a pressurized gas type according to one embodiment of the present invention, in which the fire extinguishing agent is sprayed by utilizing a carrier gas.

As shown in the drawing, a fire extinguishing agent 32 is housed in a housing vessel 31 such as a pressurized cylinder. A gas cylinder 33 loaded with a compressed carrier gas such as nitrogen gas is arranged within the housing vessel 31. A sealing plate 35 made of a sheet metal is mounted to close the opening of the gas cylinder 33. A needle pin 36 that can be moved up and down by operating a knob 37 is arranged to face the sealing plate 35. If the knob 37 is grasped, the needle pin 36 is moved downward so as to break the sealing plate 35. Then, if the knob 37 is released, a high-pressure carrier gas is spurted through the broken port of the sealing plate 35. The high-pressure carrier gas is guided from the open portion of the gas cylinder 33 into the housing section of the fire extinguishing agent 32 within the housing vessel 31 through a gas guide pipe 38. Also, a fire extinguishing agent discharge pipe 39 through which the fire extinguishing agent 32 is guided to the outside of the housing vessel 31 by the high pressure carrier gas is connected to the open portion 34 of the housing vessel 31. The fire extinguishing agent discharge pipe 39 is arranged such that the lower end of the pipe 39 is spaced from the bottom portion of the housing vessel 31 so as to prevent the lower end of the pipe 39 from being brought into contact with the bottom portion of the housing vessel 31.

Incidentally, the fire extinguisher of the present invention is not limited to that of the pressurizing type. The fire extinguisher of the present invention may be that of a so-called pressure accumulator type in which a compressed carrier gas is held directly within a housing vessel where the fire extinguishing agent is housed.

The fire extinguishing agent according to the embodiments of the present invention contains alkali hydrogencarbonate such as $NaHCO_3$. However, since the alkali hydrogencarbonate particles are coated with a hydrophobic binder such as a fluorine-containing polymer, which performs the function of a moisture resistant material, the fire extinguishing agent can be stored in a fire extinguisher without applying particular measures for preventing moisture absorption.

EXAMPLES

Examples 1–19 and Comparative Examples 1–3

Example 1

Sodium hydrogencarbonate ($NaHCO_3$) particles having an average particle size of about 1 μm and silicon dioxide ($SiO_2$) particles having an average particle size of about 0.8 μm were weighed to have a molar ratio of about 2:1. These raw material particles were mixed in a mixer for about 10 minutes so as to obtain a uniformly mixed powdery material.

The mixed powdery material thus obtained was put in a tumbling mill together with a solution containing polyvinyl butyral (hydrophobic binder) in an amount of about 2 wt % based on the total amount of the mixed powdery material, so as to perform granulation treatment for about 10 minutes and, thus, to obtain grains.

The grains were sieved by using a sieve having an opening size of about 600 μm so as to take out undersize grains. The grains thus obtained were sieved again by using a sieve having an opening size of about 400 μm so as to take out oversize grains. As a result, a granular fire extinguishing agent having an average grain size of about 500 μm was obtained.

The granular fire extinguishing agent thus obtained having an average grain size of about 500 μm was housed in a 2-liter vessel. On the other hand, about 10 liters of kerosene was put in a vessel having a bottom area of about 2 m×2 m, and the kerosene was ignited. The fire extinguishing agent was applied to the flames so as to measure the time until the extinction of the flames, thereby evaluating the fire extinguishing function. The fire was found to have been extinguished about 12 seconds after the application of the fire extinguishing agent.

Also, about 500 cc of water was put in a beaker, and about 30 g of the fire extinguishing agent was dripped from above onto the water surface so as to examine the floating state of the fire extinguishing agent on the water surface. The fire extinguishing agent was found to be capable of floating on the water surface for one week or more.

Examples 2–19 and Comparative Examples 1–3

Various fire extinguishing agents were prepared as described in the following so as to evaluate the fire extinguishing function and the floating state on the water surface as in Example 1. Table 1 shows the experiment data. Abbreviations in Table 1 are as follows: $AHCO_3$ represents an alkali hydrogencarbonate; $A_2CO_3$ represents an alkali carbonate; MO represents a metal oxide; $m_{MO}$ represents a metal oxide content by mol %; Dg represents a grain size; $w_b$ represents a binder content by wt % based on the total amount of the mixed powdery material; $T_e$ represents an fire extinguishing time; PVB represents polyvinyl butyral; LP represents liquid paraffin; WE represents wax emulsion; and CMC represents carboxymethylcellulose.

A short fire extinguishing time denotes that the fire extinguishing agent produces a satisfactory fire extinguishing function. Also, if the fire extinguishing agent is capable of floating on the water surface for at least one hour, the fire extinguishing agent is considered to be effective.

Examples 2 and 3

The fire extinguishing agent grains having an average grain size of about 20 μm (Example 2) and an average grain size of about 5 mm (Example 3) were prepared by classifying grains using sieves of various opening sizes. Incidentally, the classification was performed by using a sieve having an opening size larger than the desired average grain size and another sieve having an opening size smaller than the desired average grain size. The fire extinguishing agent was prepared as in Example 1 in the other respects.

Examples 4 and 5

The fire extinguishing agents were manufactured as in Example 1, except that the mixing ratio of $NaHCO_3$ to $SiO_2$ was set at 4:1 (Example 4) and at 0.6:1 (Example 5).

Examples 6 to 9

The fire extinguishing agents were manufactured as in Example 1, except that the materials shown in Table 1 were used as the metal oxide particles in place of $SiO_2$ and that the metal oxide content (mol %) was changed as shown in Table 1.

Examples 10 to 12

The fire extinguishing agents were manufactured as in Example 1, except that sodium hydrogencarbonate used in Example 1 was replaced by potassium hydrogencarbonate ($KHCO_3$) in Example 10, by sodium carbonate ($Na_2CO_3$) in Example 11 and by potassium carbonate ($K_2CO_3$) in Example 12.

Example 13

The fire extinguishing agent was manufactured as in Example 1, except that sodium hydrogencarbonate used in Example 1 was replaced by a mixture of $NaHCO_3$, $Na_2CO_3$ and $K_2CO_3$.

Examples 14 to 17

The fire extinguishing agents were manufactured as in Example 1, except that the polyvinyl butyral content based on the total amount of the mixed powdery material was changed to 1 wt % in Example 14, to 10 wt % in Example 15, to 0.5 wt % in Example 16 and to 15 wt % in Example 17.

Examples 18 and 19

The fire extinguishing agents were manufactured as in Example 1, except that polyvinyl butyral used in Example 1 was replaced by liquid paraffin in Example 18 and by wax emulsion in Example 19.

Comparative Example 1

Sodium hydrogencarbonate ($NaHCO_3$) particles having an average particle size of 1 μm were added to silicon dioxide ($SiO_2$) particles having an average particle size of 0.8 μm, and were mixed so as to uniformly disperse these raw material particles, thereby obtaining a fire extinguishing agent.

Comparative Example 2

Sodium hydrogencarbonate ($NaHCO_3$) particles having an average particle size of 1 μm were used as they were as a fire extinguishing agent.

Comparative Example 3

The fire extinguishing agent was manufactured as in Example 1, except that carboxymethylcellulose, which is a hydrophilic binder, was used in place of polyvinyl butyral.

TABLE 1

| | $AHCO_3$ $A_2CO_3$ | MO | $m_{MO}$ (mol %) | $D_g$ (μm) | binder | $w_b$ (wt %) | Te (sec) | float test |
|---|---|---|---|---|---|---|---|---|
| Ex. 1 | $NaHCO_3$ | $SiO_2$ | 33 | 500 | PVB | 2 | 12 | ◎ |
| Ex. 2 | $NaHCO_3$ | $SiO_2$ | 33 | 20 | PVB | 2 | 48 | ◎ |
| Ex. 3 | $NaHCO_3$ | $SiO_2$ | 33 | 5000 | PVB | 2 | 72 | ◎ |
| Ex. 4 | $NaHCO_3$ | $SiO_2$ | 20 | 500 | PVB | 2 | 80 | ◎ |
| Ex. 5 | $NaHCO_3$ | $SiO_2$ | 63 | 500 | PVB | 2 | 96 | ◎ |
| Ex. 6 | $NaHCO_3$ | $Li_2SiO_3$ | 50 | 500 | PVB | 2 | 24 | ◎ |
| Ex. 7 | $NaHCO_3$ | $Fe_2O_3$ | 33 | 500 | PVB | 2 | 48 | ◎ |
| Ex. 8 | $NaHCO_3$ | $ZrO_2$ | 50 | 500 | PVB | 2 | 40 | ◎ |
| Ex. 9 | $NaHCO_3$ | NiO | 50 | 500 | PVB | 2 | 72 | ◎ |
| Ex. 10 | $KHCO_3$ | $SiO_2$ | 33 | 500 | PVB | 2 | 30 | ◎ |
| Ex. 11 | $Na_2CO_3$ | $SiO_2$ | 33 | 500 | PVB | 2 | 35 | ◎ |
| Ex. 12 | $K_2CO_3$ | $SiO_2$ | 33 | 500 | PVB | 2 | 48 | ◎ |
| Ex. 13 | $NaHCO_3$ $Na_2CO_3$ $K_2CO_3$ | $SiO_2$ | 33 | 500 | PVB | 2 | 40 | ◎ |
| Ex. 14 | $NaHCO_3$ | $SiO_2$ | 33 | 500 | PVB | 1 | 12 | ◎ |
| Ex. 15 | $NaHCO_3$ | $SiO_2$ | 33 | 500 | PVB | 10 | 60 | ◎ |
| Ex. 16 | $NaHCO_3$ | $SiO_2$ | 33 | 500 | PVB | 0.5 | 12 | ○ |
| Ex. 17 | $NaHCO_3$ | $SiO_2$ | 33 | 500 | PVB | 15 | 120 | ◎ |
| Ex. 18 | $NaHCO_3$ | $SiO_2$ | 33 | 500 | LP | 2 | 12 | ○ |
| Ex. 19 | $NaHCO_3$ | $SiO_2$ | 33 | 500 | WE | 2 | 12 | ○ |
| Comp. Ex. 1 | $NaHCO_3$ | $SiO_2$ | 33 | 1 | none | — | 240 | X |
| Comp. Ex. 2 | $NaHCO_3$ | none | — | 1 | none | — | NE | X |
| Comp. Ex. 3 | $NaHCO_3$ | $SiO_2$ | 33 | 500 | CMC | 2 | 12 | X |

NE: not extinguished.
◎: not settled on the bottom for one week or more.
○: not settled on the bottom for one hour or more.
X: settled on the bottom within one minute.

As apparent from Table 1, the fire extinguishing time of the fire extinguishing agent for each of Examples 1 to 19 is shorter than that of the fire extinguishing agent for Comparative Example 1. It is considered reasonable to understand that, since the fire extinguishing agent grains for each of the Examples of the present invention were prepared by using a hydrophobic binder, the alkali hydrogencarbonate or the alkali carbonate and the metal oxide were allowed to react with each other efficiently so as to improve the releasing rate of carbon dioxide, leading to the short fire extinguishing time. It should also be noted that, although the fire extinguishing agent for Comparative Example 2 was incapable of achieving the flame extinction, the fire extinguishing agent for each of the Examples, which was used in the amount equal that for Comparative Example 2, was capable of extinguishing the flame. To be more specific, the experiment data clearly support that the fire extinguishing agent for each of the Examples, to which a metal oxide was added, made it possible to increase the releasing amount of carbon dioxide so as to achieve the flame extinction with a smaller amount of the fire extinguishing agent. The fire extinguishing agent for Comparative Example 3 was settled on the bottom in a time shorter than one minute, i.e., in about 30 seconds, after the uniform spraying onto the water surface. The fire extinguishing agent was settled in a short time because a hydrophilic binder was used for preparing the fire extinguishing agent for Comparative Example 3. On the other hand, the fire extinguishing agent for each of the Examples was capable of floating on the water surface for the time not shorter than one hour. This clearly supports that it is possible to apply the fire extinguishing agent for each of the Examples to various kinds of fires.

Incidentally, the experiment data given in Table 1 support that the fire extinguishing agent is capable of floating on the water surface for a longer time in the case where polyvinyl butyral is used as the hydrophobic binder, compared with the case where liquid paraffin (Example 18) or wax emulsion (Example 19) is used as the hydrophobic binder. Therefore, it is particularly desirable to use polyvinyl butyral as the hydrophobic binder. Also, as apparent from the comparison between Example 14 and Example 16, the time during which the fire extinguishing agent is allowed to float on the water surface can be drastically prolonged in the case where the polyvinyl butyral content is not lower than 1 wt %. It should be noted, however, that, in order to greatly reduce the fire extinction time, it is desirable for the polyvinyl butyral content to be not higher than 10 wt %.

Examples 20–48 and Comparative Examples 4–6

Each of these Examples is directed to the fire extinguishing agent prepared by using a fluorine-containing polymer having a polyfluoroalkyl group as a hydrophobic binder.

Example 20

Sodium hydrogencarbonate ($NaHCO_3$) particles having an average particle size of about 1 μm and silicon dioxide ($SiO_2$) particles having an average particle size of about 0.8 μm were weighed to have a molar ratio of about 2:1. These raw material powders were mixed in a mixer for about 10 minutes so as to obtain a uniformly mixed powdery material.

The mixed powdery material thus obtained was put in a tumbling mill together with a solution prepared by dissolving in m-xylene hexafluoride a polymer of $C_8H_{17}(CH_2)_2OCOCH{=}CH_2$ (hydrophobic binder) in an amount of about 2 wt % based on the total amount of the mixed powdery material so as to perform granulation for about 10 minutes and, thus, to obtain grains.

The grains were sieved by using a sieve having an opening size of about 600 μm so as to take out undersize grains. The grains thus obtained were sieved again by using a sieve having an opening size of about 400 μm so as to take out oversize grains. As a result, a granular fire extinguishing agent having an average grain size of about 500 μm was obtained.

The granular fire extinguishing agent thus obtained having an average grain size of about 500 μm was housed in a 2-liter vessel. On the other hand, about 10 liters of kerosene was put in a vessel having a bottom area of about 2 m×2 m, and the kerosene was ignited. The fire extinguishing agent was applied to the fire so as to measure the time until the extinction of the fire, thereby evaluating the fire extinguishing function. The fire was found to have been extinguished about 10 seconds after the application of the fire extinguishing agent.

Also, about 500 cc of n-heptane was put in a beaker, and about 30 g of the fire extinguishing agent was dripped from above onto the oil surface so as to examine the floating state of the fire extinguishing agent on the oil surface. The fire extinguishing agent was found to be capable of floating on the oil surface for one week or more.

Examples 21–48 and Comparative Examples 4–6

Various fire extinguishing agents were prepared as described in the following so as to evaluate the fire extinguishing function and the floating state on the oil surface as in Example 20. Table 2 also shows the experiment data. Abbreviations in Table 2 are same as those in Table 1.

A short fire extinguishing time denotes that the fire extinguishing agent produces a satisfactory fire extinguishing function. Also, if the fire extinguishing agent is capable of floating on the oil surface for at least one hour, the fire extinguishing agent is considered to be effective.

Examples 21 and 22

The fire extinguishing agent grains having an average grain size of about 20 μm (Example 21) and an average grain size of about 5 mm (Example 22) were prepared by classifying grains using sieves of various opening sizes. The classification was performed by using a sieve having an opening size larger than the desired average grain size and another sieve having an opening size smaller than the desired average grain size. The fire extinguishing agent was prepared as in Example 20 in the other respects.

Examples 23 and 24

The fire extinguishing agents were manufactured as in Example 20, except that the mixing ratio of $NaHCO_3$ to $SiO_2$ was set at 4:1 (Example 23) and at 0.6:1 (Example 24).

Examples 25 to 28

The fire extinguishing agents were manufactured as in Example 20, except that the materials shown in Table 2 were used as the metal oxide particles in place of $SiO_2$ and that the metal oxide content (mol %) was changed as shown in Table 2.

Examples 29 to 31

The fire extinguishing agents were manufactured as in Example 20, except that sodium hydrogencarbonate used in Example 20 was replaced by potassium hydrogencarbonate ($KHCO_3$) in Example 29, by sodium carbonate ($Na_2CO_3$) in Example 30 and by potassium carbonate ($K_2CO_3$) in Example 31.

Example 32

The fire extinguishing agent was manufactured as in Example 20, except that sodium hydrogencarbonate used in Example 20 was replaced by a mixture of $NaHCO_3$, $Na_2CO_3$ and $K_2CO_3$.

Examples 33 to 36

The fire extinguishing agents were manufactured as in Example 20, except that the $C_8H_{17}(CH_2)_2OCOCH{=}CH_2$ polymer content based on the total amount of the mixed powdery material was changed to 1 wt % in Example 33, to 10 wt % in Example 34, to 0.5 wt % in Example 35 and to 15 wt % in Example 36.

Examples 37 and 48

The fire extinguishing agents were manufactured as in Example 20, except that polymers of the respective monomers given below were used as the fluorine-containing polymers in place of the polymer of $C_8H_{17}(CH_2)_2OCOCH{=}CH_2$:

$C_8H_{17}(CH_2)_2OCOC(CH_3){=}CH_2$ (Example 37);
$C_8H_{17}CH_2OCOCH{=}CH_2$ (Example 38);
$C_8H_{17}CH_2(CH_3)CHOCOCH{=}CH_2$ (Example 39);
$C_8H_{17}SO_2NH(CH_2)_2OCOCH{=}CH_2$ (Example 40);
$C_8H_{17}CONH(CH_2)_2OCOCH{=}CH_2$ (Example 41);
$C_8H_{17}SO_2N(CH_3)(CH_2)_2OCOCH{=}CH_2$ (Example 42);
$C_8H_{17}CON(CH_3)(CH_2)_2OCOCH{=}CH_2$ (Example 43);
$C_8H_{17}SO_2N(C_2H_5)(CH_2)_2OCOCH{=}CH_2$ (Example 44);
$C_8H_{17}CON(C_2H_5)(CH_2)_2OCOCH{=}CH_2$ (Example 45);
$C_8H_{17}SO_2N(C_3H_7)(CH_2)_2OCOCH{=}CH_2$ (Example 46);
$C_8H_{17}CON(C_3H_7)(CH_2)_2OCOCH{=}CH_2$ (Example 47);
$C_8H_{17}SO_2N(CH_3)(CH_2)_2OCH_2(CH_2Cl)OCOCH{=}CH_2$ (Example 48).

Comparative Example 4=Comparative Example 1

Sodium hydrogencarbonate ($NaHCO_3$) particles having an average particle size of 1 μm were added to silicon dioxide ($SiO_2$) particles having an average particle size of 0.8 μm, and were mixed so as to uniformly disperse these raw material particles, thereby obtaining a fire extinguishing agent.

Comparative Example 5=Comparative Example 2

Sodium hydrogencarbonate ($NaHCO_3$) particles having an average particle size of 1 μm were used as they were as a fire extinguishing agent.

Comparative Example 6=Comparative Example 3

The fire extinguishing agent was manufactured as in Example 20, except that carboxymethylcellulose, which is a hydrophilic binder, was used in place of a polymer of $C_8H_{17}(CH_2)_2OCOCH{=}CH_2$ used in Example 20.

TABLE 2

| | $AHCO_3$ $A_2CO_3$ | MO | $m_{MO}$ (mol %) | $D_g$ (μm) | binder (monomer unit) | $w_b$ (wt %) | Te (sec) | float test |
|---|---|---|---|---|---|---|---|---|
| Ex. 20 | $NaHCO_3$ | $SiO_2$ | 33 | 500 | $C_8H_{17}(CH_2)_2OCOCH{=}CH_2$ | 2 | 10 | ◎ |
| Ex. 21 | $NaHCO_3$ | $SiO_2$ | 33 | 20 | $C_8H_{17}(CH_2)_2OCOCH{=}CH_2$ | 2 | 45 | ◎ |
| Ex. 22 | $NaHCO_3$ | $SiO_2$ | 33 | 5000 | $C_8H_{17}(CH_2)_2OCOCH{=}CH_2$ | 2 | 70 | ◎ |
| Ex. 23 | $NaHCO_3$ | $SiO_2$ | 20 | 500 | $C_8H_{17}(CH_2)_2OCOCH{=}CH_2$ | 2 | 78 | ◎ |
| Ex. 24 | $NaHCO_3$ | $SiO_2$ | 63 | 500 | $C_8H_{17}(CH_2)_2OCOCH{=}CH_2$ | 2 | 91 | ◎ |
| Ex. 25 | $NaHCO_3$ | $Li_2SiO_3$ | 50 | 500 | $C_8H_{17}(CH_2)_2OCOCH{=}CH_2$ | 2 | 21 | ◎ |
| Ex. 26 | $NaHCO_3$ | $Fe_2O_3$ | 33 | 500 | $C_8H_{17}(CH_2)_2OCOCH{=}CH_2$ | 2 | 40 | ◎ |
| Ex. 27 | $NaHCO_3$ | $ZrO_2$ | 50 | 500 | $C_8H_{17}(CH_2)_2OCOCH{=}CH_2$ | 2 | 35 | ◎ |
| Ex. 28 | $NaHCO_3$ | NiO | 50 | 500 | $C_8H_{17}(CH_2)_2OCOCH{=}CH_2$ | 2 | 69 | ◎ |
| Ex. 29 | $KHCO_3$ | $SiO_2$ | 33 | 500 | $C_8H_{17}(CH_2)_2OCOCH{=}CH_2$ | 2 | 28 | ◎ |
| Ex. 30 | $Na_2CO_3$ | $SiO_2$ | 33 | 500 | $C_8H_{17}(CH_2)_2OCOCH{=}CH_2$ | 2 | 33 | ◎ |
| Ex. 31 | $K_2CO_3$ | $SiO_2$ | 33 | 500 | $C_8H_{17}(CH_2)_2OCOCH{=}CH_2$ | 2 | 44 | ◎ |
| Ex. 32 | $NaHCO_3$ $Na_2CO_3$ $K_2CO_3$ | $SiO_2$ | 33 | 500 | $C_8H_{17}(CH_2)_2OCOCH{=}CH_2$ | 2 | 37 | ◎ |
| Ex. 33 | $NaHCO_3$ | $SiO_2$ | 33 | 500 | $C_8H_{17}(CH_2)_2OCOCH{=}CH_2$ | 1 | 10 | ◎ |
| Ex. 34 | $NaHCO_3$ | $SiO_2$ | 33 | 500 | $C_8H_{17}(CH_2)_2OCOCH{=}CH_2$ | 10 | 58 | ◎ |
| Ex. 35 | $NaHCO_3$ | $SiO_2$ | 33 | 500 | $C_8H_{17}(CH_2)_2OCOCH{=}CH_2$ | 0.5 | 10 | ○ |
| Ex. 36 | $NaHCO_3$ | $SiO_2$ | 33 | 500 | $C_8H_{17}(CH_2)_2OCOCH{=}CH_2$ | 15 | 105 | ◎ |
| Ex. 37 | $NaHCO_3$ | $SiO_2$ | 33 | 500 | $C_8H_{17}(CH_2)_2OCOC(CH_3){=}CH_2$ | 2 | 10 | ◎ |
| Ex. 38 | $NaHCO_3$ | $SiO_2$ | 33 | 500 | $C_8H_{17}CH_2OCOCH{=}CH_2$ | 2 | 10 | ◎ |
| Ex. 39 | $NaHCO_3$ | $SiO_2$ | 33 | 500 | $C_8H_{17}CH_2(CH_3)CHOCOCH{=}CH_2$ | 2 | 11 | ◎ |
| Ex. 40 | $NaHCO_3$ | $SiO_2$ | 33 | 500 | $C_8H_{17}SO_2NH(CH_2)_2OCOCH{=}CH_2$ | 2 | 11 | ◎ |
| Ex. 41 | $NaHCO_3$ | $SiO_2$ | 33 | 500 | $C_8H_{17}CONH(CH_2)_2OCOCH{=}CH_2$ | 2 | 11 | ◎ |
| Ex. 42 | $NaHCO_3$ | $SiO_2$ | 33 | 500 | $C_8H_{17}SO_2N(CH_3)(CH_2)_2OCOCH{=}CH_2$ | 2 | 11 | ◎ |
| Ex. 43 | $NaHCO_3$ | $SiO_2$ | 33 | 500 | $C_8H_{17}CON(CH_3)(CH_2)_2OCOCH{=}CH_2$ | 2 | 11 | ◎ |
| Ex. 44 | $NaHCO_3$ | $SiO_2$ | 33 | 500 | $C_8H_{17}SO_2N(C_2H_5)(CH_2)_2OCOCH{=}CH_2$ | 2 | 12 | ◎ |
| Ex. 45 | $NaHCO_3$ | $SiO_2$ | 33 | 500 | $C_8H_{17}CON(C_2H_5)(CH_2)_2OCOCH{=}CH_2$ | 2 | 12 | ◎ |
| Ex. 46 | $NaHCO_3$ | $SiO_2$ | 33 | 500 | $C_8H_{17}SO_2N(C_3H_7)(CH_2)_2OCOCH{=}CH_2$ | 2 | 12 | ◎ |
| Ex. 47 | $NaHCO_3$ | $SiO_2$ | 33 | 500 | $C_8H_{17}CON(C_3H_7)(CH_2)_2OCOCH{=}CH_2$ | 2 | 12 | ◎ |
| Ex. 48 | $KHCO_3$ | $SiO_2$ | 33 | 500 | $C_8H_{17}SO_2N(CH_3)(CH_2)_2OCH_2(CH_2Cl)OCOCH{=}CH_2$ | 2 | 12 | ◎ |
| Comp. Ex. 4 | $NaHCO_3$ | $SiO_2$ | 33 | 1 | none | — | 240 | X |
| Comp. Ex. 5 | $NaHCO_3$ | none | — | 1 | none | — | NE | X |
| Comp. Ex. 6 | $NaHCO_3$ | $SiO_2$ | 33 | 500 | CMC | 2 | 12 | X |

NE: not extinguished.
◎: not settled on the bottom for one week or more.
○: not settled on the bottom for one hour or more.
X: settled on the bottom within one minute.

As apparent from Table 2, the fire extinguishing time of the fire extinguishing agent for each of Examples 20 to 48 is shorter than that of the fire extinguishing agent for Comparative Example 4. It is considered reasonable to understand that, since the fire extinguishing agent grains for each of the Examples of the present invention were prepared by using a fluorine-containing polymer having a polyfluoroalkyl group as a hydrophobic binder, the alkali hydrogencarbonate or the alkali carbonate and the metal oxide were allowed to react with each other efficiently so as to improve the releasing rate of carbon dioxide, leading to the short fire extinguishing time. It should also be noted that, although the fire extinguishing agent for Comparative Example 5 was incapable of achieving the flame extinction, the fire extinguishing agent for each of the Examples of the present invention, which was used in the amount equal that for Comparative Example 5, was capable of extinguishing the flame. To be more specific, the experiment data clearly support that the fire extinguishing agent for each of the Examples, to which a metal oxide was added, made it possible to increase the releasing amount of carbon dioxide so as to achieve the flame extinction with a smaller amount of the fire extinguishing agent. The fire extinguishing agent for Comparative Example 6 was settled on the bottom in a time shorter than one minute, i.e., in about 30 seconds, after the uniform spraying onto the oil surface. On the other hand, the fire extinguishing agent for each of the Examples was capable of floating on the oil surface for a time not less than one hour, because a fluorine-containing polymer having a polyfluoroalkyl group was used as a hydrophobic binder. This clearly supports that it is possible to apply the fire extinguishing agent for each of the Examples to various kinds of fire.

Incidentally, as apparent from the comparison between Example 33 and Example 35, the time during which the fire extinguishing agent floats on the oil surface can be drastically prolonged in the case where the fluorine-containing polymer content is not less than 1 wt %. It should be noted, however, that, in order to greatly reduce the fire extinction time, it is desirable for the fluorine-containing polymer content to be not higher than 10 wt %.

Additional advantages and modifications will readily occur to those skilled in the art. Therefore, the present invention in its broader aspects is not limited to the specific details and representative embodiments shown and described herein. Accordingly, various modifications may be made without departing from the spirit or scope of the general inventive concept as defined by the appendec claims and their equivalents.

What is claimed is:

1. A fire extinguishing agent, comprising:

an alkali hydrogencarbonate capable of thermally decomposing to generate carbon dioxide and an alkali carbonate;

silicon dioxide capable of reacting with the alkali carbonate to generate carbon dioxide; and a hydrophobic binder;

wherein the silicon dioxide is contained in an amount falling within a range between 20 mol % and 80 mol % based on the sum of the alkali hydrogencarbonate and the silicon dioxide.

2. The fire extinguishing agent according to claim 1, wherein the alkali hydrogencarbonate is at least one compound selected from the group consisting of sodium hydrogencarbonate and potassium hydrogencarbonate.

3. The fire extinguishing agent according to claim 1, wherein the hydrophobic binder is at least one material selected from the group consisting of polyvinyl butyral, liquid paraffin, wax emulsion, and polyvinyl acetate.

4. The fire extinguishing agent according to claim 1, wherein the hydrophobic binder is a fluorine-containing polymer having a polyfluoroalkyl group.

5. The fire extinguishing agent according to claim 4, wherein the polyfluoroalkyl group comprises 1 to 20 carbon atoms.

6. The fire extinguishing agent according to claim 4, wherein the fluorine-containing polymer is at least one polymer selected from the group consisting of a polymer of perfluoroalkylethyl acrylate and a polymer of perfluoroalkylethyl methacrylate.

7. The fire extinguishing agent according to claim 1, wherein the hydrophobic binder is contained in an amount falling within a range of between 1 wt % and 10 wt %.

8. The fire extinguishing agent according to claim 1, wherein the fire extinguishing agent grains have an average grain size of 0.5 μm to 5 mm.

9. The fire extinguishing agent according to claim 1, wherein the fire extinguishing agent has a density not higher than 1 $g/cm^3$.

10. The fire extinguishing agent according to claim 9, wherein the fire extinguishing agent has a density falling within a range of between 0.8 $g/cm^3$ and 0.95 $g/cm^3$.

11. A fire extinguisher, comprising:

the fire extinguishing agent according to claim 1;

a housing vessel housing the fire extinguishing agent; and a compressed carrier gas enabling the fire extinguishing agent to be spurted from within the housing vessel.

* * * * *